US005797661A

United States Patent [19]

Lee et al.

[11] Patent Number: 5,797,661

[45] Date of Patent: Aug. 25, 1998

[54] WHEEL OF A VACUUM CLEANER

[75] Inventors: Jin Bang Lee, Incheon; Seon Kyu Kim; Suk Gu Kim, both of Seoul, all of Rep. of Korea

[73] Assignee: Daewoo Electronics Co., Ltd., Seoul, Rep. of Korea

[21] Appl. No.: 430,606

[22] Filed: Apr. 28, 1995

[30] Foreign Application Priority Data

Jul. 14, 1994 [KR] Rep. of Korea ..... 1994-17412 U
Jul. 14, 1994 [KR] Rep. of Korea ..... 1994-17416 U
Jul. 14, 1994 [KR] Rep. of Korea ..... 1994-17417 U

[51] Int. Cl.[6] ..... B60B 19/00

[52] U.S. Cl. ..... 301/111; 301/5.1; 384/416

[58] Field of Search ..... 301/1, 5.1, 105.1, 301/111, 121, 122, 64.7; 16/45, 46; 384/291, 416

[56] References Cited

U.S. PATENT DOCUMENTS 3,131,977 5/1964 Wirtz ..... 384/291
3,813,054 5/1974 Klingspor ..... 301/112 X
4,963,115 10/1990 Davin et al. ..... 301/111 X
5,222,786 6/1993 Sovis et al. ..... 301/111
5,413,414 5/1995 Bauer ..... 384/291 X
5,598,605 2/1997 Tomasiak ..... 301/111 X
5,647,828 7/1997 Chen ..... 301/111 X

*Primary Examiner*—Russell D. Stormer
*Attorney, Agent, or Firm*—Fish & Richardson P.C.

[57] ABSTRACT

Disclosed is a wheel of a vacuum cleaner which can be easily assembled and disassembled. The wheel has a hollow cylindrical hub incorporated with a cleaner body, a roller supporting the cleaner body while rolling on a floor, a support member, and a cap. The support member and the cap are fixed by a plurality of key protuberances and snap protuberances formed on the cap. The roller is rotatably supported by the support member while being in sliding contact with a plurality of ridges formed on a cylindrical outer surface of a support ring of the support member. The wheel enables a vacuum cleaner to be minimized in size.

12 Claims, 8 Drawing Sheets

WHEEL OF A VACUUM CLEANER

BACKGROUND OF THE INVENTION

1. Field of the Invention

The present invention relates to a wheel of a vacuum cleaner, and more particularly to a wheel of a vacuum cleaner by which the size of the vacuum cleaner can be minimized, and which can be easily assembled with and disassembled from the cleaner body of the vacuum cleaner.

2. Prior Arts

Generally, a vacuum cleaner is an appliance which sucks dirt such as dust through a brush and collects it in a dust collection chamber. As shown in FIG. 7, a conventional vacuum cleaner has a cleaner body 10 for accommodating relatively heavy parts such as a motor, a brush 12 for sucking dirt such as dust, and a flexible hose 14 and extension pipes 16 for connecting brush 12 to cleaner body 10. Cleaner body 10 has a front wheel 18 and a pair of rear wheels 20 installed respectively at front and rear lower parts thereof so as to bear the weight of cleaner body 10 and enable cleaner body 10 to move easily.

Though FIG. 7 shows only a canister type vacuum cleaner in which cleaner body 10 separated from brush 12 has wheels, the vacuum cleaners of any other types, such as an upright type vacuum cleaner in which a brush is incorporated with a cleaner body, also have wheels installed at the cleaner body so as to support the cleaner and make the movement of the vacuum cleaner easy.

FIG. 8 shows an exploded perspective view of a wheel 20 provided in one of the vacuum cleaners as described above. Wheel 20 includes a hub 30 incorporated with a side wall of cleaner body 10, and a roller 40, an inner cap 50, and an outer cap 60, respectively separated from cleaner body 10. A plurality of bosses 32 incorporated with cleaner body 10 is disposed in a recess enclosed by hub 30.

Roller 40 has a center opening 48 formed at the center thereof, a cylindrical flange 44 disposed along the circumference of center opening 48, a rim 42 disposed along the outer periphery of roller 40, and a skirt 46 disposed between rim 42 and flange 44 so as to make them incorporated with each other. Flange 44 has a gear formed at a cylindrical inner surface thereof.

Inner cap 50 has a plurality of screw holes 52 formed at a middle portion thereof and corresponding to bosses 32, and an annular groove 54 formed around screw holes 52 and having a larger diameter than that of flange 44.

The diameter of outer cap 60 is the same as that of annular groove 54.

When wheel 20 is to be assembled with cleaner body 10 as shown in FIG. 9, hub 30 is inserted into center opening 48 of roller 40, firstly. Then, inner cap 50 is covered thereon, and screws 56 are screwed through screw holes 52 and center opening 48 into bosses 32 so as to secure inner cap 50. After that, outer cap 60 is fitted into annular groove 54, so that the assembling is completed.

As described above, hub 30, inner cap 50 and outer cap 60 are fixed, while roller 40 is rotatably installed. In this case, friction between an outer surface of hub 30 and an inner surface of flange can be reduced due to the gear formed on the inner surface of flange 44.

Meanwhile, the weight of the vacuum cleaner is lighter than that of a general vehicle such as a car, and the wheel of the vacuum cleaner does not require high-speed revolution, that is, the revolutionary speed of the wheel of the vacuum cleaner is slower than that of other vehicles. For this reason, differently from the wheels of other vehicles, the vacuum cleaner can adopt a wheel in which only roller 40 can be rotated without the rotation of other parts of the wheel.

However, the wheel of vacuum cleaner constructed as mentioned above has disadvantages as follows.

First, since inner cap 50 for preventing deviation of roller 40 is secured by means of the screws, not only separate bosses 32 for fixing the screws are required but also the parts of the wheel cannot be easily assembled and disassembled.

Further, as shown in FIG. 9, there is; a useless space occupied by hub 30 in the wheel so that the volume of the vacuum cleaner, as well as the wheel, becomes larger with no use.

SUMMARY OF THE INVENTION

The present invention has been made to overcome the above described problems of the prior arts, and accordingly it is an object of the present invention to provide a wheel of a vacuum cleaner, which can be assembled and disassembled easily, in which a separate member for assembling is not required, and by which the internal space of vacuum cleaner can be used more efficiently so that the volume of the vacuum cleaner can be reduced.

To achieve the above object, the present invention provides a wheel of a vacuum cleaner comprising:

- a hollow cylindrical hub formed integrally with a body of the vacuum cleaner;
- a roller for supporting the body of the vacuum cleaner while rolling on a floor;
- a first means being in sliding contact with the roller and supporting the roller rotatably; and
- a second means for securing the first means to the hub.

Preferably, the roller includes an annular rim, and an annular flange protruding radially inward from the rim.

According to one aspect of the present invention, the first means includes a support member having a first disc plate, and a cylindrical support ring protruding perpendicularly from the first disk plate and inserted between the hub and the rim.

Further, the hub has a plurality of L-shaped locking holes formed on a cylindrical peripheral surface thereof, and a plurality of first engagement holes and a plurality of first snap holes formed in a front surface thereof, each set of the locking holes, the first engagement holes, and first snap holes respectively being spaced apart at regular circumferential intervals from each other.

The first disc plate has a plurality of second engagement holes and a plurality of second snap holes formed therein and respectively corresponding to the first engagement holes and snap holes, the second engagement holes and second snap holes respectively being spaced apart at regular circumferential intervals from each other.

The second means includes a plurality of key protuberances protruding radially inward from an inner cylindrical surface of the support ring so as to be engaged with the locking holes, and a cap having a second disc plate, and a plurality of engagement protuberances and a plurality of snap protuberances formed on a surface of the cap, the engagement protuberances and the snap protuberances respectively being spaced apart at regular circumferential intervals from each other so as to be inserted respectively through the first engagement holes and the second engagement holes and through the first snap holes and the second snap holes.

The support ring has a plurality of ridges protruding radially outward from an outer cylindrical surface thereof so as to be in sliding contact with the rim.

According to another aspect of the present invention, the first means includes a cylindrical support ring inserted between the hub and the rim.

The hub has a plurality of L-shaped locking holes formed on a cylindrical peripheral surface thereof, and a plurality of snap holes formed on a front surface thereof, the locking holes and the snap holes respectively being spaced apart at regular circumferential intervals from each other.

The second means includes a plurality of key protuberances protruding radially inward from an inner cylindrical surface of the support ring so as to be engaged with the locking holes, and a cap having a disc plate, and a plurality of engagement protuberances and a plurality of snap protuberances disposed on a surface of the disc plate and respectively spaced apart at regular circumferential intervals, so that the engagement protuberances are inserted beside the key protuberances in the locking holes and the snap protuberances are engaged with the snap holes.

According to another aspect of the present invention, the first means includes a cap having a disc plate, and a cylindrical support ring protruding perpendicularly from a periphery of the disk plate and inserted between the hub and the rim.

The hub has a plurality of L-shaped locking holes formed in a cylindrical peripheral surface thereof, and a plurality of snap holes formed on a front surface thereof, the locking holes and the snap holes respectively being spaced apart at regular circumferential intervals from each other, each of the snap holes having an elastic flap provided at an edge thereof.

The second means includes a plurality of key protuberances protruding radially inward from an inner cylindrical surface of the support ring so as to be engaged with the locking holes, and a plurality of snap protuberances protruding from the disc plate in the same direction as the support ring does, the snap protuberances being spaced apart at regular circumferential intervals, so that the snap protuberances are pushed into the snap holes while forcing the elastic flap and engaged therewith.

When the wheel having the above described construction is assembled, the support ring is inserted in the roller so that the ridges are in contact with the inner surface of the rim and the inner free end of the support ring is abutted to the flange. Next, the key protuberances are inserted into the locking holes, and the snap protuberances are inserted through the first and the second snap holes so that the cap is secured on the support member.

When the wheel is driven, the support member and the cap do not rotate because the support member and the cap are coupled with the hub, but only the roller rotates. In this case, the ridges are in sliding contact with the rim while the roller rotates. The hub has a hollow cylindrical shape so as to enable the space inside the hub to be utilized more efficiently.

BRIEF DESCRIPTION OF THE DRAWINGS

The above objects and other advantages of the present invention will become more apparent by describing in detail the preferred embodiments thereof with reference to the attached drawings, in which.

DETAILED DESCRIPTION OF THE EMBODIMENTS

Hereinafter, several preferred embodiments of the present invention will be described in detail with reference to the accompanying drawings.

Embodiment 1

Figure 1:
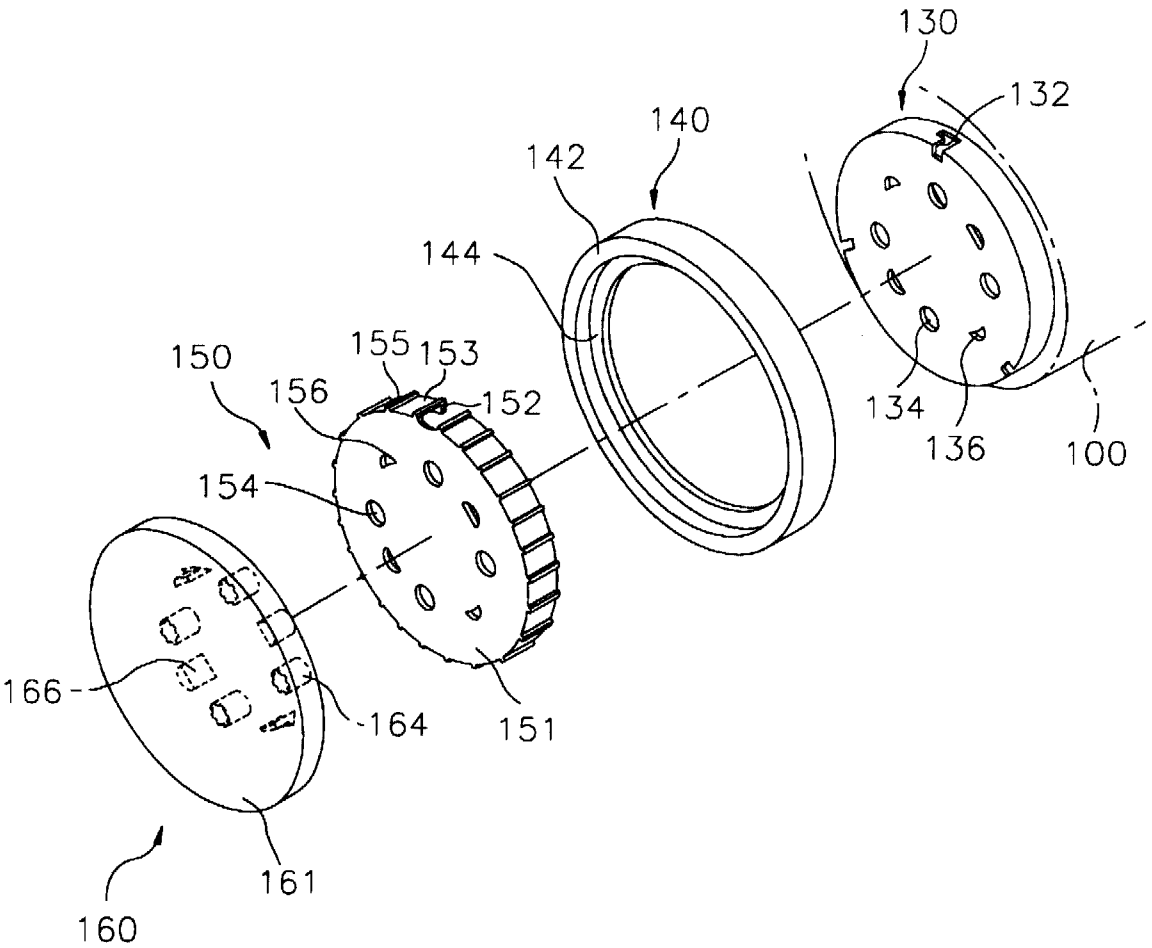
FIGS. 1 and 2 are respectively an exploded perspective view and a side sectional view of a wheel of a vacuum cleaner according to the first embodiment of the present invention.
Figure 2:
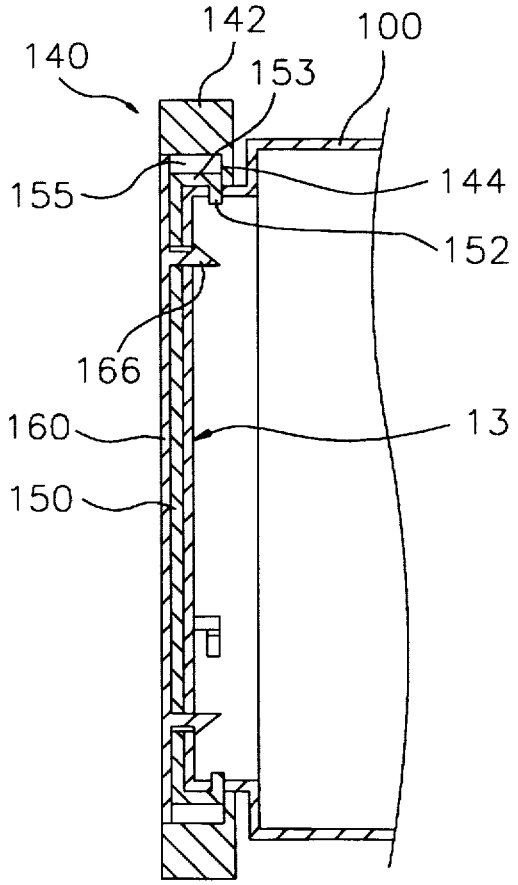

Referring to FIGS. 1 and 2 showing a wheel of a vacuum cleaner according to the first embodiment of the present invention, the wheel includes a hub 130 formed incorporated with a cleaner body 100, and a roller 140, a support member 150, and a cap 160 respectively separated from cleaner body 100.

As apparent from the FIGS. 1 and 2, hub 130 has a shape of a hollow cylindrical tank having a diameter nearly equal to that of cleaner body 100.

Hub 130 includes a plurality of L-shaped locking holes 132 formed in a cylindrical outer peripheral surface thereof, and a plurality of first engagement holes 134 and a plurality of first snap holes 136 formed in a front surface thereof. Each set of locking holes; 132, and first engagement holes 134 and first snap holes 136 are respectively spaced apart at regular circumferential intervals.

Roller 140 has an annular rim 142 rolling upon and being in contact with a floor of an area in which the vacuum cleaner is moved, and a flange 144 protruding radially inward from a side of a circumferential portion of rim 142.

Support member 150 has a first disc plate 151, a cylindrical support ring 153 extending perpendicularly to first disc plate 151 from an edge thereof, a plurality of ridges 155 protruding radially outward from the outer cylindrical surface of support ring 153 and extending in the same direction as support ring 153 does, and a plurality of key protuberances 152 protruding radially inward from the inner cylindrical surface of support ring 153 and corresponding to locking holes 132 respectively.

First disc plate 151 has a plurality of second engagement holes 154 and a plurality of second snap holes 156 formed therein. Second engagement holes 154 and second snap holes 156 are respectively spaced apart at regular circumferential intervals, and respectively correspond to first engagement holes 134 and first snap holes 136.

Cap 160 includes a second disc plate 161, and a plurality of engagement protuberances 164 and a plurality of snap protuberances 166 formed in second disc plate 161. Engagement protuberances 164 and snap protuberances 166 are respectively spaced apart at regular circumferential intervals. Engagement protuberances 164 correspond to first and second engagement holes 134 and 154. Snap protuberances 166 correspond to first and second snap holes 136 and 156.

Meanwhile, according to other embodiments, ridges 155 may be formed on an inner cylindrical surface of rim 142 so as to be in sliding contact with an outer cylindrical surface of support ring 153, instead of being formed on the outer cylindrical surface of support ring 153 as are in the present embodiment.

Hereinafter, the process of assembling the wheel having the above described construction according to the present embodiment will be described.

First, support member 150 is inserted in roller 140 so that ridges 155 disposed on support ring 153 are in contact with the inner surface of rim 142, and the inner free end of support ring 153 is abutted to flange 144. Next, key protuberances 152 are inserted into locking holes 132, and then support member 150 having been assembled with roller 140 as mentioned above is rotated so that key protuberances 152 are guided along the L-shape of locking holes 132, and accordingly support member 150 assembled with roller 140 is securely coupled to hub 130. In this case, first and second engagement holes 134 and 154 are aligned with each other, and so are first and second snap holes 136 and 156.

Then, engagement protuberances 164 are inserted through first and second engagement holes 143 and 154, and snap protuberances 166 are inserted through first and second snap holes 136 and 156, so that cap 160 is secured on support member 150. Cap 160 is maintained in the assembled position by the engagement of snap protuberances 166 in first and second snap holes 136 and 156. FIG. 2 is a cross-sectional view of the wheel assembled as described above.

When the wheel is driven, support member 150 and cap 160 do not rotate because support member 150 and cap 160 are coupled with hub 130, but only roller 140 rotates. In this case, ridges 155 are in sliding contact with rim 142 while roller 140 rotates. Further, a force for separating key protuberances 152 from locking holes 132 can be applied to key protuberances 152 due to the slidable contact between ridges 155 and rim 142 in case that locking holes 132 extend in a direction inverse to that of the main rotation of roller 140. Therefore, it is preferred that locking holes 132 are extended and bent along the direction that roller 140 mainly rotates.

In the wheel according to the first embodiment of the present invention as described above, separate members such as screw and boss are not required for assembling the wheel, and thereby not only space for such members can be reduced but also the wheel can be easily assembled and disassembled. Further, because hub 130 can be formed to have a hollow cylindrical shape incorporated with cleaner body 100 and to have a diameter nearly equal to that of cleaner body 100, the space inside hub 130 in cleaner body 100 can also be utilized, and accordingly the volume of cleaner body 100 can be reduced.

Embodiment 2

Figure 3:
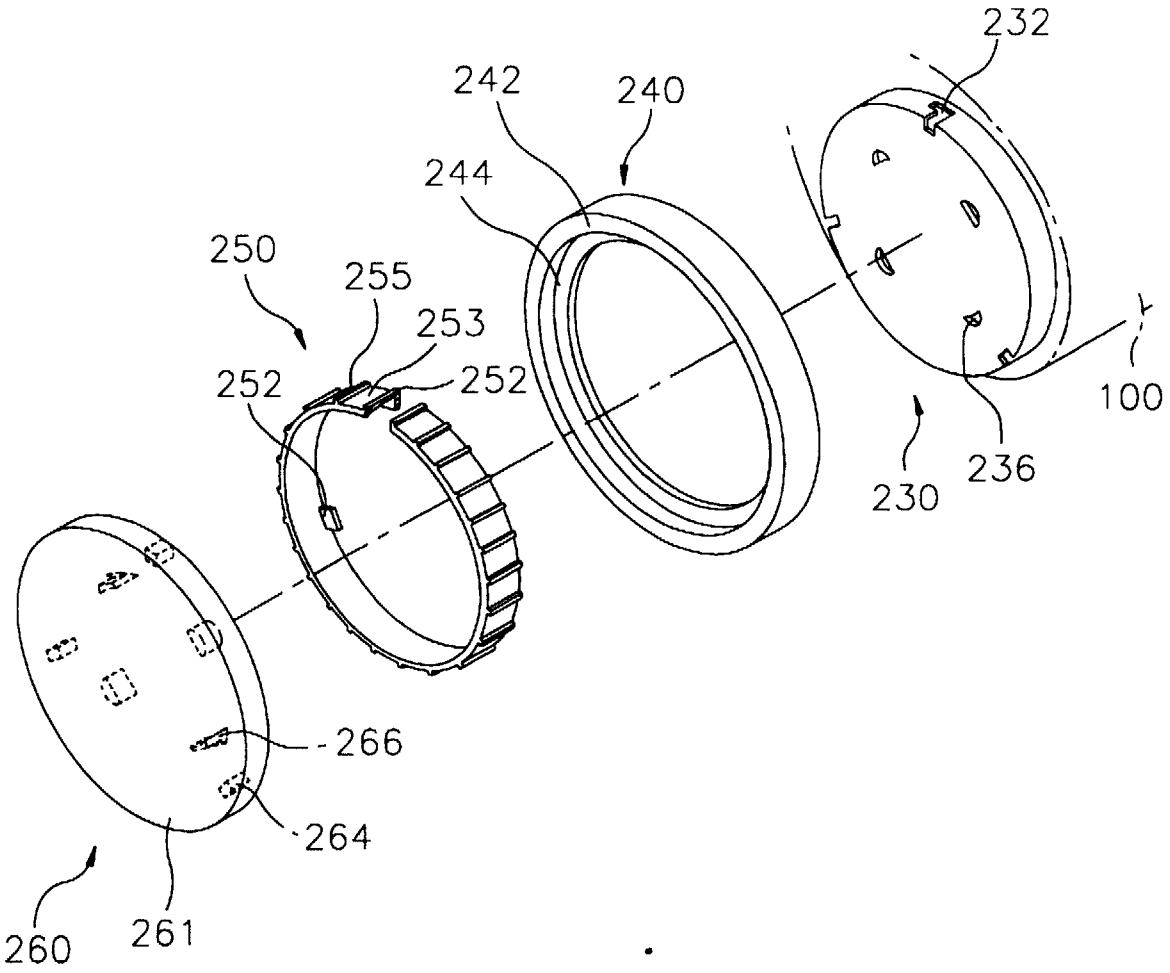
FIGS. 3 and 4 are respectively an exploded perspective view and a side sectional view of a wheel of a vacuum cleaner according to the second embodiment of the present invention.
Figure 4:
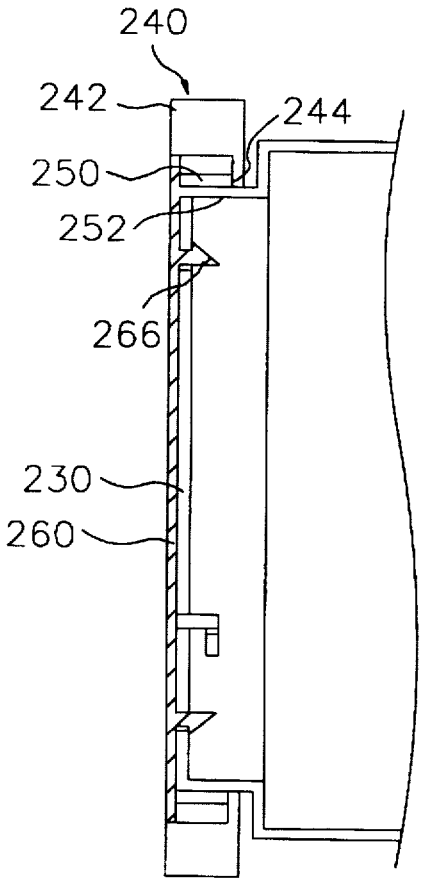

Referring to FIGS. 3 and 4 showing a wheel of a vacuum cleaner according to the second embodiment of the present invention, the wheel includes a hub 230 formed incorporated with a cleaner body 100, and a roller 240, a support member 250, and a cap 260 respectively separated from cleaner body 100.

Hub 230 has a plurality of L-shaped locking holes 232 formed in a cylindrical outer peripheral surface thereof, and a plurality of snap holes 236 formed in a front surface thereof. Each set of locking holes 232 and snap holes 236 are respectively spaced apart at regular circumferential intervals.

Roller 240 has an annular rim 242 rolling upon and being in contact with a floor of an area in which the vacuum cleaner is moved, and a flange 244 protruding radially inward from a side of a circumferential portion of rim 242.

Support member 250 has a cylindrical support ring 253, a plurality of ridges 255 protruding radially outward from the outer cylindrical surface of support ring 253, and a plurality of key protuberances 252 protruding radially inward from the inner cylindrical surface of support ring 253 and respectively corresponding to locking holes 232.

Cap 260 includes a disc plate 261, and a plurality of engagement protuberances 264 and a plurality of snap protuberances 266 formed in second disc plate 261. Engagement protuberances 264 and snap protuberances 266 are respectively spaced apart at regular circumferential intervals. Engagement protuberances 264 correspond to locking holes 232. Snap protuberances 266 correspond to snap holes 236.

Meanwhile, according to other embodiments, ridges 255 may be formed on an inner cylindrical surface of rim 242 so as to be in sliding contact with an outer cylindrical surface of support ring 253.

Hereinafter, the process of assembling the wheel having the above described construction according to the present embodiment will be described.

First, support member 250 is inserted into roller 240 so that ridges 255 disposed on support ring 253 are in contact with the inner surface of rim 242 and the inner free end of support ring 253 is abutted to flange 244. Next, key protuberances 252 are inserted into locking holes 232 and are rotated so as to be guided along the L-shape of locking holes 232, and accordingly support member 250 assembled with roller 240 is securely coupled to hub 230.

Then, engagement protuberances 164 are so inserted into locking holes 232 as to hold key protuberances 252 having been inserted therein, while snap protuberances 266 are inserted into snap holes 236, so that cap 260 is secured on support member 250. Engagement protuberances 164 prevent key protuberances 252 from being separated from locking holes 232.

Cap 260 is maintained in the assembled position by the engagement of snap protuberances 266 in snap holes 236. FIG. 4 is a cross-sectional view of the wheel assembled as described above.

When the wheel is driven, support member 250 and cap 260 do not rotate because support member 250 and cap 260 are coupled with hub 230, but only roller 240 rotates. In this case, ridges 255 are in sliding contact with rim 242 while roller 240 rotates. Further, a force for separating key protuberances 252 from locking holes 232 can be applied to key protuberances 252 due to the slidable contact between ridges 255 and rim 242 in case that locking holes 232 extend in a direction inverse to the main rotational direction of roller 240. Therefore, it is preferred that locking holes 232 are extended and bent along the direction that roller 240 mainly rotates.

According to the second embodiment of the present invention as described above, there is a further advantage that first disc plate 151 is not necessary, in addition to the advantages by the first embodiment. Moreover, the first and second engagement holes 134 and 154 need not be formed, so that the wheel can be more easily manufactured and thereby the manufacturing cost thereof can be reduced.

Embodiment 3

Figure 5:
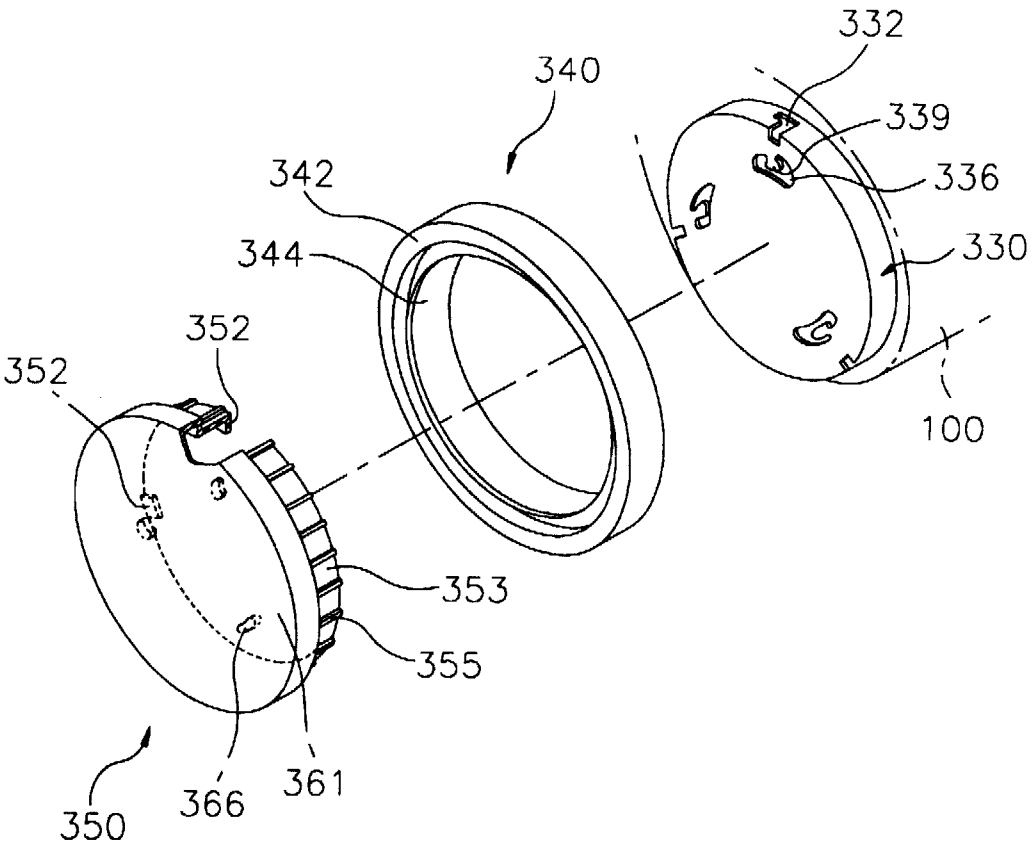
FIGS. 5 and 6 are respectively an exploded perspective view and a side sectional view of a wheel of a vacuum cleaner according to the third embodiment of the present invention.
Figure 6:
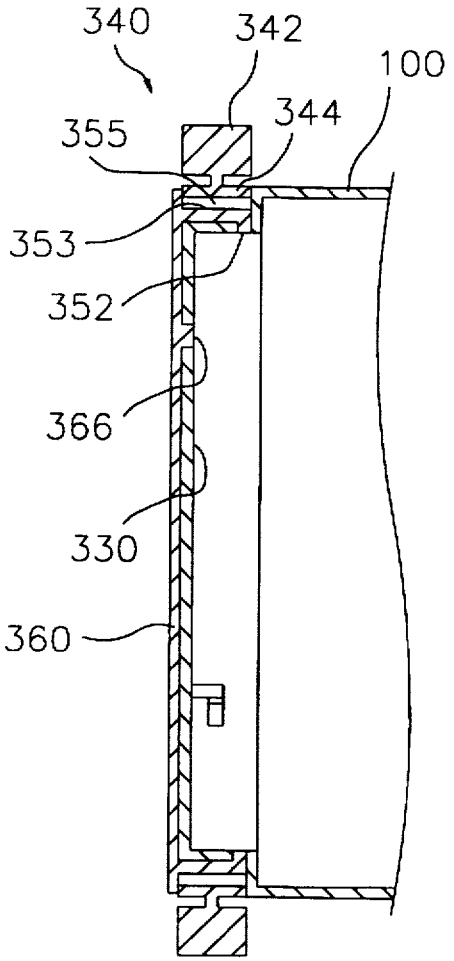
Figure 7:
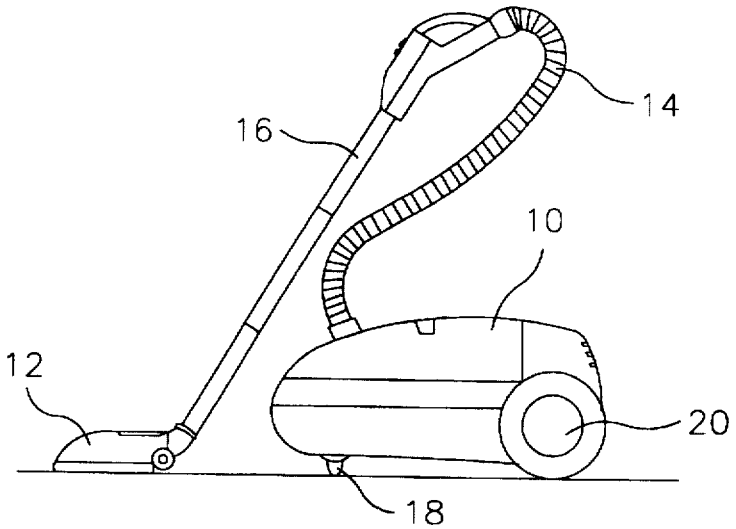
FIG. 7 PRIOR ART
FIG. 7 is a schematic constructional view of a conventional vacuum cleaner.
Figure 8:
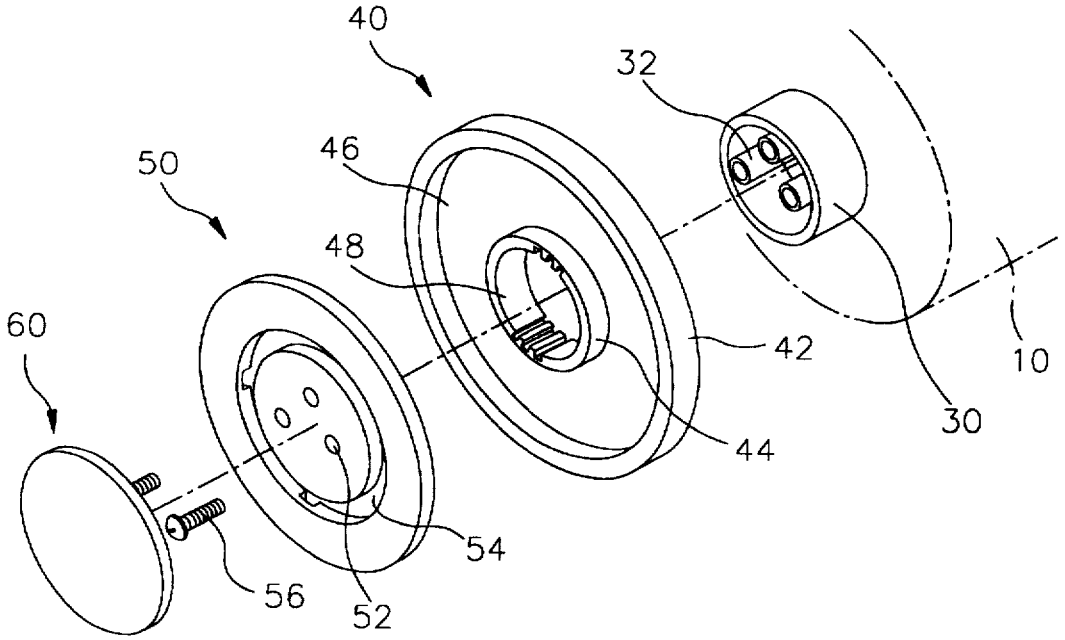
FIG. 8 PRIOR ART
FIGS. 8 and 9 are respectively an exploded perspective view and a side sectional view of a conventional wheel of the vacuum cleaner shown in FIG. 7.
Figure 9:
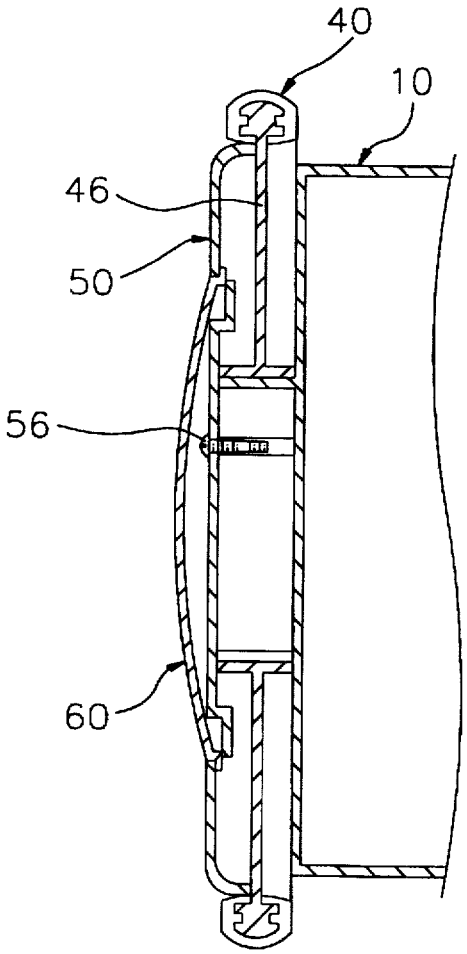
FIG. 9 PRIOR ART

Referring to FIGS. 5 and 6 showing a wheel of a vacuum cleaner according to the third embodiment of the present invention, the wheel includes a hub 330 formed incorporated with a cleaner body 100, and a roller 340 and a cap 360 respectively separated from cleaner body 100.

Hub 330 has a plurality of L-shaped locking holes 332 formed in a cylindrical outer peripheral surface thereof, and a plurality of snap holes 336 formed in a front surface thereof. Each set of locking holes 332 and snap holes 336 are respectively spaced apart at regular circumferential intervals. Each of snap holes 336 has an elastic flap 339 disposed at an edge thereof.

Roller 340 has an annular rim 342 rolling upon and being in contact with a floor of an area in which the vacuum cleaner is moved, and a flange 344 protruding radially inward from a side of a circumferential portion of rim 342. Roller 344 has a shape of a letter "T".

Cap 360 includes a disc plate 361, a cylindrical support ring 353 protruding from disc plate 361 perpendicularly thereto, a plurality of ridges 355 protruding radially outward from the outer cylindrical surface of support ring 353, a plurality of key protuberances 352 protruding radially inward from the inner cylindrical surface of support ring 353 and respectively corresponding to locking holes 332, and a plurality of snap protuberances 366 protruding in the same direction as support ring 353 does. Snap protuberances 366 are respectively spaced apart at regular circumferential intervals and correspond to snap holes 336. Support ring 353 has a diameter larger than that of hub 330 but smaller than that of flange 344 which is smaller than that of disc plate 361.

Meanwhile, according to other embodiments, ridges 355 may be formed on an inner cylindrical surface of rim 342 so as to be in sliding contact with an outer cylindrical surface of support ring 353.

Hereinafter, the process of assembling the wheel having the above described construction according to the present embodiment will be described.

First, support ring 353 of cap 360 is inserted into roller 340 so that ridges 355 disposed on support ring 353 are in contact with the inner cylindrical surface of flange 344. Next, key protuberances 352 are inserted into locking holes 332 and are rotated so as to be guided along the L-shape of locking holes 232, while snap protuberances 366 are inserted in snap holes 336, rotated while pressing elastic flaps 339, and elastically held by elastic flaps 339.

Cap 360 is prevented from being rotated and separated from hub 330 due to the engagement between snap protuberances 366 and elastic flaps 339, and accordingly key protuberances 352 are prevented from being separated from locking holes 332. FIG. 6 is a cross-sectional view of the wheel assembled as described above.

When the wheel is driven, cap 360 does not rotate because cap 360 is coupled with hub 330, but only roller 340 rotates. In this case, ridges 355 are in sliding contact with flange 344 of rim 342 while roller 340 rotates. Further, a force for separating key protuberances 352 from locking holes 332 can be applied to key protuberances 352 due to the slidable contact between ridges 355 and flange 344 in case that locking holes 332 extend in a direction inverse to the main rotational direction of roller 340. Therefore, it is preferred that locking holes 332 are extended and bent along the direction that roller 340 mainly rotates.

The above described wheel according to the present embodiment is the more improved one compared to those according to the preceding embodiments, and thereby has further advantages that support ring 353 is incorporated with cap 360 so that the manufacture of the wheel is easier and the manufacturing cost thereof is further reduced.

According to the present invention as described above, separate members such as screw and boss are not required for assembling the wheel, and thereby not only space for such members can be reduced but also the wheel can be easily assembled and disassembled. Further, because the hub can be formed to have a hollow cylindrical shape incorporated with the cleaner body and to have a diameter nearly equal to that of the cleaner body, the space inside the hub in the cleaner body can also be utilized, and accordingly the volume of the cleaner body can be reduced. Furthermore, according to the second and the third embodiments of the present invention, the wheel can be manufactured more easily, and the manufacturing cost thereof can be reduced because some components of the wheel can be abridged.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A wheel of a vacuum cleaner, the wheel comprising:

a hollow cylindrical hub formed integrally with a body of the vacuum cleaner, and having a front surface and a peripheral surface integrally formed between the front surface and the body;

a roller for supporting the body of the vacuum cleaner while rolling on a floor, the roller having an annular rim and an annular flange protruding radially inward from the annular rim;

a first means for supporting the roller rotatable, the first means being in sliding contact with the roller, the first means including a support member having a first disc plate, and a cylindrical support ring protruding perpendicularly alone the periphery of the first disk plate and inserted between the hub and the annular rim; wherein the hub has a plurality of L-shaped locking holes formed on the peripheral surface thereof, and a plurality of first engagement holes and a plurality of first snap holes formed in the front surface thereof, the locking holes, the first engagement holes, and first snap holes respectively being spaced apart at regular circumferential intervals from each other, the first disc plate has a plurality of second engagement holes and a plurality of second snap holes formed therein and respectively corresponding to the first engagement holes and snap holes, the second engagement holes and second snap holes respectively being spaced apart at regular circumferential intervals from each other, and the first means includes a plurality of key protuberances protruding radially inward from the cylindrical support ring so as to be engaged with the locking holes, and the second means includes a cap having a second disc plate, and a plurality of engagement protuberances and a plurality of snap protuberances formed on a surface of the second disc plate, the engagement protuberances and the snap protuberances respectively being spaced apart at regular circumferential intervals from each other so as to be inserted respectively through the first engagement holes and the second engagement holes and through the first snap holes and the second snap holes.

2. A wheel of a vacuum cleaner as claimed in claim 1, the wheel further comprising a third means for reducing friction between the support ring and the annular rim.

3. A wheel of a vacuum cleaner as claimed in claim 2, wherein the third means comprises a plurality of ridges protruding radially outward from the cylindrical support ring so as to be in sliding contact with the annular rim.

4. A wheel of a vacuum cleaner, the wheel comprising:

a hollow cylindrical hub formed integrally with a body of the vacuum cleaner, and having a front surface and a peripheral surface integrally formed between the front surface and the body;

a roller for supporting the body of the vacuum cleaner while rolling on a floor, the roller having an annular rim;

a first means for supporting the roller rotatably, the first means being in sliding contact with the roller and including a cylindrical support ring inserted between the hub and the annular rim of the roller; and a second means for securing the first means to the hub, wherein the hub has a plurality of L-shaped locking holes formed on the peripheral surface thereof, and a plurality of snap holes formed on the front surface thereof, the locking holes and the snap holes respectively being spaced apart at regular circumferential intervals from each other, and the first means comprises a plurality of key protuberances protruding radially inward from the cylindrical support ring so as to be engaged with the locking holes, and the second means includes a cap having a disc plate, and a plurality of engagement protuberances and a plurality of snap protuberances disposed on a surface of the disc plate and respectively being spaced apart at regular circumferential intervals, so that the engagement protuberances are inserted beside the key protuberances in the locking holes and the snap protuberances are engaged with the snap holes.

5. A wheel of a vacuum cleaner as claimed in claim 4, the wheel further comprising a third means for reducing friction between the support ring and the annular rim.

6. A wheel of a vacuum cleaner as claimed in claim 5, wherein the third means comprises a plurality of ridges protruding radially outward from the cylindrical support ring so as to be in sliding contact with the annular rim.

7. A wheel of a vacuum cleaner, the wheel comprising:

a hollow cylindrical hub formed integrally with a body of the vacuum cleaner, and having a front surface and a peripheral surface integrally formed between the front surface and the body;

a roller for supporting the body of the vacuum cleaner while rolling on a floor, a first means for supporting the roller rotatably, the first means being in sliding contact with the roller; and a second means for securing the first means to the hub, wherein the hub has a plurality of L-shaped locking holes formed in the peripheral surface thereof, and a plurality of snap holes formed on the front surface thereof, the locking holes an the snap holes respectively being spaced apart at regular circumferential intervals from each other, each of the snap holes having an elastic flap provided at an edge thereof, and the second means comprising a plurality of key protuberances protruding radially inward from the cylindrical support ring so as to be engaged with the locking holes, and a plurality of snap protuberances protruding from the disc plate in a same direction as the support ring does, the snap protuberances being spaced apart at regular circumferential intervals, so that the snap protuberances are pushed into the snap holes while forcing the elastic flap and engaged therewith.

8. A wheel of a vacuum cleaner as claimed in claim 7, the wheel further comprising a third means for reducing friction between the support ring and the annular rim.

9. A wheel of a vacuum cleaner as claimed in claim 8, wherein the third means comprises a plurality of ridges protruding radially outward from the cylindrical support ring so as to be in sliding contact with the annular rim.

10. A wheel of a vacuum cleaner comprising:

a hollow cylindrical hub formed integrally with a body of the vacuum cleaner and having a front surface and a peripheral surface integrally formed between the front surface and the body, the hub having a plurality of L-shaped locking holes formed on a peripheral surface thereof, and a plurality of first engagement holes and a plurality of first snap holes formed in the front surface thereof, the locking holes, the first engagement holes, and the first snap holes respectively being spaced apart at regular circumferential intervals from each other;

a roller having an annular rim, and an annular flange protruding radially inward from the annular rim;

a support member including a first disc plate, a cylindrical support ring protruding perpendicularly from a periphery of the first disk plate and inserted between the hub and the annular rim, a plurality of ridges protruding radially outward from the cylindrical support ring so as to be in sliding contact with the annular rim, and a plurality of key protuberances protruding radially inward from an inner surface of the cylindrical support ring so as to be engaged with the locking holes, the first disc plate having a plurality of second engagement holes and a plurality of second snap holes formed therein and respectively corresponding to the first engagement holes and snap holes, the second engagement holes and second snap holes respectively being spaced apart at regular circumferential intervals from each other; and a cap having a second disc plate, and a plurality of engagement protuberances and a plurality of snap protuberances formed on a surface of the cap, the engagement protuberances and the snap protuberances respectively being spaced apart at regular circumferential intervals from each other so as to be inserted respectively through the first engagement holes and the second engagement holes and through the first snap holes and the second snap holes.

11. A wheel of a vacuum cleaner comprising:

a hollow cylindrical hub formed integrally with a body of the vacuum cleaner and having a front surface and a peripheral surface integrally formed between the front surface and the body, the hub having a plurality of L-shaped locking holes formed on a peripheral surface thereof, and a plurality of snap holes formed in the front surface thereof, the locking holes the snap holes respectively being spaced apart at regular circumferential intervals from each other;

a roller having an annular rim, and an annular flange protruding radially inward from the annular rim;

a support member including a cylindrical support ring inserted between the hub and the annular rim, a plurality of ridges protruding radially outward from the cylindrical support ring so as to be in sliding contact with the annular rim, and a plurality of key protuberances protruding radially inward from the cylindrical support ring so as to be engaged with the locking holes; and a cap having a disc plate, and a plurality of engagement protuberances and a plurality of snap protuberances formed on a surface of the cap, the engagement protuberances being inserted beside the key protuberances in the locking holes, and the snap protuberances being engaged with the snap holes.

12. A wheel of a vacuum cleaner comprising:

a hollow cylindrical hub formed integrally with a body of the vacuum cleaner and having a front surface and a peripheral surface integrally formed between the front surface and the body, the hub having a plurality of L-shaped locking holes formed on a peripheral surface thereof, and a plurality of snap holes formed in the front surface thereof, the locking holes the snap holes respectively being spaced apart at regular circumferential intervals from each other;

a roller having an annular rim, and an annular flange protruding radially inward from the annular rim; and a cap having a disc plate, a cylindrical support ring protruding perpendicularly from the disk plate and inserted between the hub and the annular rim, a plurality of ridges protruding radially outward from the cylindrical support ring so as to be in sliding contact with the annular rim, a plurality of key protuberances protruding radially inward from the cylindrical support ring so as to be engaged with the locking holes, and a plurality of snap protuberances protruding from the disc plate in a same direction as the support ring does, the snap protuberances being spaced apart at regular circumferential intervals, so that the snap protuberances are pushed into the snap holes while forcing the elastic flap and engaged therewith.

* * * * *